US009079439B2

(12) United States Patent
Leoni et al.

(10) Patent No.: US 9,079,439 B2
(45) Date of Patent: Jul. 14, 2015

(54) ROTATABLE PRINTHEAD ASSEMBLY

(75) Inventors: Napoleon J Leoni, San Jose, CA (US); Henryk Birecki, Palo Alto, CA (US); Omer Gila, Cupertino, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 250 days.

(21) Appl. No.: 13/446,606

(22) Filed: Apr. 13, 2012

(65) Prior Publication Data

US 2013/0271517 A1 Oct. 17, 2013

(51) Int. Cl.

| | |
|---|---|
| ***B41J 29/38*** | (2006.01) |
| ***B41J 25/316*** | (2006.01) |
| ***B41J 2/175*** | (2006.01) |
| *B41J 25/00* | (2006.01) |

(52) U.S. Cl.

CPC ..... *B41J 25/316* (2013.01); *B41J 2/175* (2013.01); *B41J 2/17566* (2013.01); *B41J 2025/008* (2013.01)

(58) Field of Classification Search

CPC ..... B41J 29/38; B41J 2/175; B41J 2/17596; B41J 2/18; B41J 2/17509; B41J 2/125; B41J 2/04563; B41J 2/17513

See application file for complete search history.

(56) References Cited

U.S. PATENT DOCUMENTS

| | | | | |
|---|---|---|---|---|
| 6,070,977 | A | 6/2000 | Nuita et al. | |
| 6,126,267 | A | 10/2000 | Ito et al. | |
| 6,149,262 | A * | 11/2000 | Shiida et al. | 347/37 |
| 6,231,251 | B1 | 5/2001 | Clark | |
| 6,523,934 | B1 | 2/2003 | Beauchamp et al. | |
| 7,300,147 | B2 | 11/2007 | Johnson | |
| 7,455,401 | B2 * | 11/2008 | Koto et al. | 347/104 |
| 7,866,802 | B2 | 1/2011 | Nozawa et al. | |
| 7,976,123 | B2 | 7/2011 | Parks et al. | |
| 8,011,768 | B2 | 9/2011 | Hayashi et al. | |
| 8,033,640 | B2 * | 10/2011 | Koike et al. | 347/36 |
| 8,061,297 | B2 | 11/2011 | Albertalli et al. | |
| 2006/0170729 | A1 * | 8/2006 | Sloan et al. | 347/37 |
| 2008/0049080 | A1 | 2/2008 | Hayashi et al. | |
| 2008/0165229 | A1 | 7/2008 | Umeda | |
| 2009/0096823 | A1 * | 4/2009 | Watt et al. | 347/10 |
| 2011/0199409 | A1 | 8/2011 | Lee et al. | |
| 2012/0274684 | A1 * | 11/2012 | Kelly et al. | 347/6 |

* cited by examiner

*Primary Examiner* — Manish S Shah
*Assistant Examiner* — Jeremy Delozier
(74) *Attorney, Agent, or Firm* — Paul S. Grunzweig; Dicke, Billig & Czaja

(57) ABSTRACT

A printing assembly includes a pressure control tank and a printhead assembly. The printhead assembly is in fluid communication with the pressure control tank while the printhead assembly and the pressure control tank are selectively rotatable into a plurality of different positions relative to one another.

5 Claims, 7 Drawing Sheets

ROTATABLE PRINTHEAD ASSEMBLY

BACKGROUND

Electrophotographic printers typically employ a laser to electrostatically form an image on a surface of a rotary drum and then transfer the image via toner to a media such as paper. In this arrangement, the rotary drum acts as an intermediate imaging substrate. In contrast, many inkjet printers include an array of inkjet printheads arranged to print directly onto a print medium, such as paper, presented as separate sheets or as a web. Another type of printer includes a rotary drum to transport a print medium while employing inkjet printheads adjacent the drum surface to fire ink onto the media, thereby forming images on the media.

As printing configurations continue to evolve, inkjet printheads continue to face new challenges that threaten to hamper their performance.

DETAILED DESCRIPTION

Figures 1A, 1B:
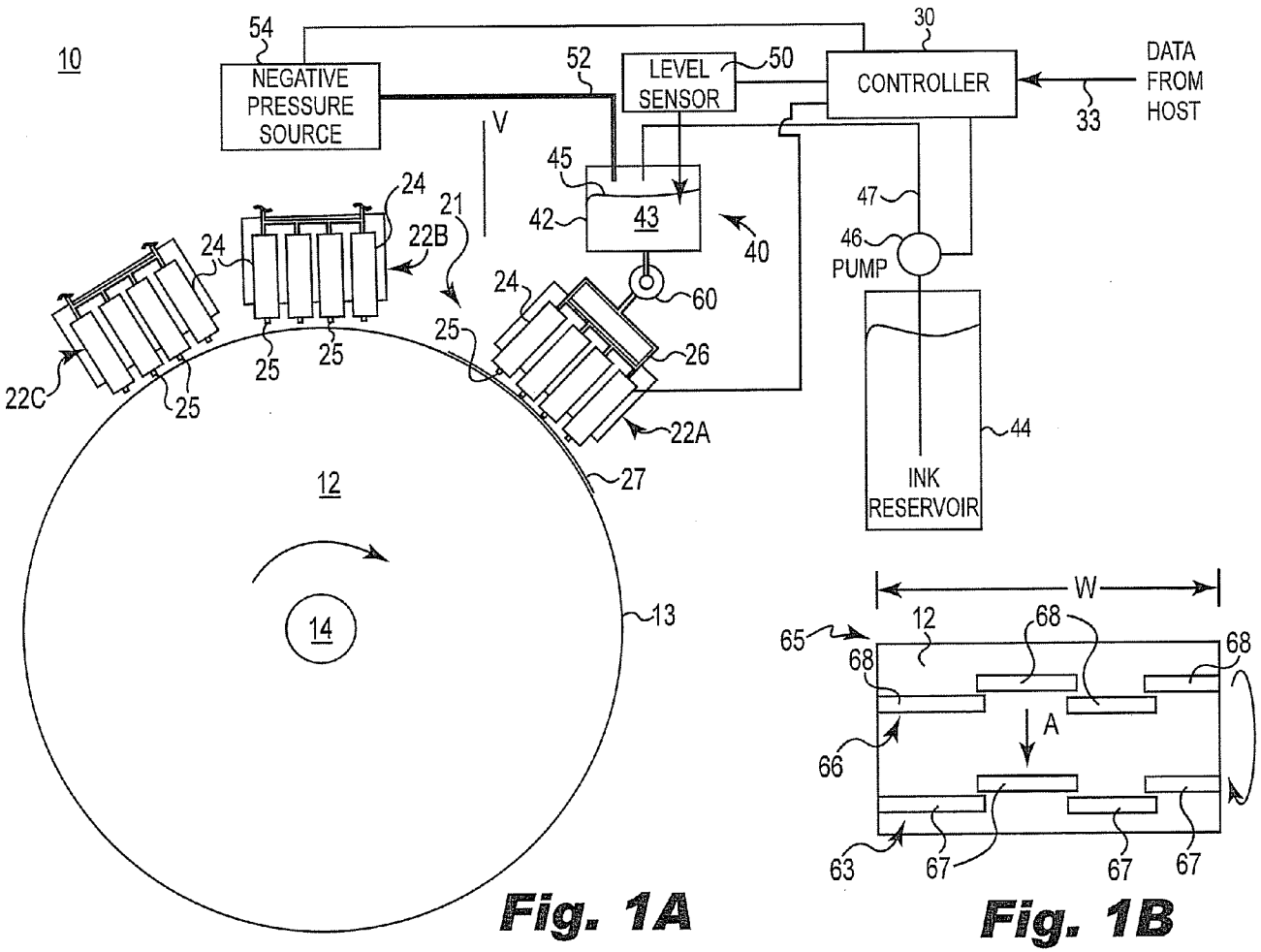
FIG. 1A is a block diagram schematically illustrating an example of one printing system in the present disclosure.
FIG. 1B is a top plan view schematically illustrating an example of one printing system in the present disclosure.

In the following detailed description, reference is made to the accompanying drawings which form a part hereof, and in which is shown by way of illustration specific examples which may be practiced. In this regard, directional terminology, such as "top," "bottom," "front," "back," "leading," "trailing," etc., is used with reference to the orientation of the Figure(s) being described. Because components in these examples can be positioned in a number of different orientations, the directional terminology is used for purposes of illustration and is in no way limiting. It is to be understood that other examples may be utilized and structural or logical changes may be made without departing from the scope of the present disclosure. The following detailed description, therefore, is not to be taken in a limiting sense.

At least some examples of printing systems in the present disclosure are directed to maintaining a desired meniscus pressure and/or accurate ink level sensing for a fluid ejection device, such as an inkjet printhead, despite varied orientations of the fluid ejection device.

One example of a printing system in the present disclosure includes a printhead assembly arranged to align a firing path of the printhead assembly to be generally perpendicular to surface of the rotary drum. The printhead assembly is fluidically and mechanically coupled to a pressure control tank with the pressure control tank vertically disposed above the printhead assembly. The pressure control tank is selectively rotatable into a plurality of different orientations relative to the droplet firing path of the printhead assembly to align the pressure control tank in a generally vertical posture.

In this arrangement, the pressure control tank and the printhead assembly are selectively rotatable relative to each other to simultaneously achieve a desired rotational orientation of the printhead relative to the imaging substrate while also achieving a desired rotational orientation of the pressure control tank to ensure a desired performance of the printhead assembly. In one aspect, this arrangement enables maintaining a consistent meniscus pressure in multiple printhead assemblies despite the different rotational orientations of respective printhead assemblies relative to the imaging substrate.

With this capability, one example of a printing system in the present disclosure includes an array of printhead assemblies arranged in series in a generally arcuate pattern about the periphery of a rotary drum with at least some of the printhead assemblies arranged in a different rotational orientation relative to a generally vertical orientation without sacrificing performance of the printhead assemblies and their associated pressure control tanks. In one aspect, this capability enables a much greater quantity of inkjet printhead assemblies to be arrayed about a rotary drum in an arcuate pattern to increase print quality, throughput, and/or to expand the range of printing options (e.g. more colors) for a single pass of a print medium.

By enabling selective rotation of a pressure control tank relative to its associated printhead assembly, regardless of which varied rotational orientation the printhead assembly exhibits, the pressure control tank is positionable to maintain a consistent meniscus pressure and consistent level of ink within the pressure control tank. Accordingly, in at least some examples of a printing system in the present disclosure, consistently accurate readings are obtained from the ink level sensor in the pressure control tank because the surface of the ink is not tilted too severely, as might otherwise occur if the pressure control tank was not rotatable relative to the printhead assembly and the printhead assembly was in a sufficiently non-vertical orientation. In the example printing system, consistent readings by the ink level sensor enable maintaining a target level (and volume) of ink within the pressure control tank, which in turn, enables maintaining a target meniscus pressure and adequate ink supply to the printheads.

Moreover, the adjustability of the rotational orientation of the pressure control tank (relative to its associated printhead assembly) to maintain a generally vertical posture ensures that a vacuum port (defined in a wall of the pressure control tank) does not become submerged within the ink in the pressure control tank. If such an obstruction may occur, it may produce unconnected air bubbles at unknown pressures on a free surface of the ink in the pressure control tank, which is generally detrimental to maintaining a well-controlled meniscus pressure.

In another aspect, the adjustability of the rotational orientation of the example pressure control tank (relative to its associated printhead assembly) to maintain a generally upright posture of the control tank ensures that a mouth of an ink fill conduit remains submerged below a surface of ink within the pressure control tank. This relationship, in turn, prevents foaming and/or entraining air into the ink that might otherwise occur if the pressure control tank were not rotatable relative to its associated printhead assembly, as in an existing system in which a tilted angle of the printhead assembly (and its non-rotatable control tank) could expose the mouth to air within the control tank.

In addition, by adjusting the rotational position of the pressure control tank to compensate for the rotational orientation of the associated printhead assembly, at least some examples of printing system in the present disclosure facilitates that the lowest point of the chamber in the pressure control tank drains into the printhead assembly. This arrangement avoids potential accumulation of sediments over time, thereby preventing coagulation of the sediments into larger particles and associated clogging behaviors. Rather, in at least some examples of a printing system in the present disclosure, good drainage is assured with little or no sediment accumulation because of the rotational positioning of the pressure control tank into a generally vertical orientation and/or because a lower portion of the pressure control tank in the example printing system has an angled shape that facilitates positive drainage of ink out of the pressure control tank.

Existing systems (having pressure control tanks that are not rotatably positionable relative to their printhead assemblies) face numerous challenges, as described above, in maintaining proper meniscus pressure when the printhead assemblies are placed in non-standard orientations (e.g. non-horizontal orientations). However, by providing a pressure control tank that is selectively, rotatably positionable relative to a printhead assembly, the example printing systems enable placing printhead assemblies at non-standard orientations (e.g. non-horizontal orientations) while maintaining proper meniscus pressure control.

These example printing systems, and other example printing systems, are described and illustrated in association with FIGS. 1-10.

FIG. 1 illustrates an example inkjet printing system 10 of the present disclosure. Inkjet printing system 10 comprises one example of a fluid ejection system which includes a fluid ejection assembly, such as an inkjet printhead assembly 22A, and an associated fluid supply assembly 40. A coupling 60 is interposed between the inkjet printhead assembly 22A and the fluid supply assembly 40 with the coupling 60 providing for selective rotational positioning of the printhead assembly 22A and a portion of the fluid supply assembly 40 relative to one another. In addition, the coupling 60 provides fluid communication of ink from fluid supply assembly 40 into printhead assembly 22A, as will be described more fully below. Printhead assemblies 22B, 22C have substantially the same features and attributes as printhead assembly 22A.

As shown in FIG. 1A, the fluid supply assembly 40 includes a pressure control tank 42, an ink reservoir 44, and a pump 46 interposed between the pressure control tank 42 and the ink reservoir 44. The fluid supply assembly 40 includes an ink level sensor 50, and a negative pressure source 54 having a vacuum conduit 52 in fluid communication with an interior of the pressure control tank 42. The ink level sensor 50 is coupled to the pressure control tank 42 and detects a level of ink in pressure control tank 42, which is communicated to controller 30. In the illustrated example, inkjet printing system 10 also includes a media transport assembly such as rotary drum 12.

Inkjet printhead assembly 22A includes printheads 24, which eject drops of ink or fluid through a plurality of orifices or nozzles 25 onto a print medium 27.

In one example, printhead assembly 22A includes a frame portion and a fluid ejecting element that is removably received into the frame portion, such that the fluid ejecting element is a consumable or replaceable element. In other examples, the printhead assembly 22A includes a frame portion supporting a fluid ejecting element that is not removable or replaceable relative to the frame portion.

Print medium 27 is any type of suitable sheet material, such as paper, transparencies, etc. Typically, nozzles 25 are arranged in columns or arrays such that properly sequenced ejection of ink from nozzles 25 causes, in one example, characters, symbols, and/or other graphics or images to be printed upon print medium 27 as print medium 27 is moved past inkjet printhead assembly 22A.

In one example, printing system 10 comprises a page wide printing configuration 65 as schematically illustrated in FIG. 1B. As shown in FIG. 1B, array 63 of printhead assemblies 67 and array 66 of printhead assemblies 68 both extend across a full width (W) of rotary drum 12. Accordingly, the printhead assemblies of each array are arranged in a staggered, overlapping pattern to achieve full printing coverage over the width of the rotary drum 12. Accordingly, an image is printable onto a print medium (or intermediate imaging substrate) in a single pass as the print medium passes (represented by directional arrow A) underneath one of the respective arrays 63, 66. It will be understood that, in at least some examples, the side view of printhead assembly 22A in FIG. 1A is representative of a page wide array of printhead assemblies 22A, like array 63 of printhead assemblies 67 shown in FIG. 1B. Finally, printhead assemblies 67, 68 shown in FIG. 1B have at least substantially the same features and attributes as printhead assemblies 22A, 22B, and 22C in FIG. 1A.

With further reference to FIG. 1A, ink supply assembly 40, as one example of a fluid supply assembly, supplies ink to printhead assembly 22A and includes pressure control tank 42 for storing a small supply of ink sufficient to operate printhead assembly 22A while ink reservoir 44 stores a larger quantity of ink that is used to replenish ink in pressure control tank 42. In one example, pump 46 is interposed between pressure control tank 42 and ink reservoir 44 with pump 46 acting to transfer ink from reservoir 44 to pressure control tank 42.

A level of ink is maintained in pressure control tank 42 that is sufficient to maintain the meniscus pressure within a target range to operate printhead assembly 22A. Ink level sensor 50 tracks a level (and therefore a volume) of the ink and calls to controller 30 for delivery of more ink as appropriate to maintain the desired level of ink within pressure control tank 42.

In addition, a first end of vacuum conduit 52 is exposed within an interior of the pressure control tank 42 and an opposite, second end of vacuum conduit 52 is external to pressure control tank 42 for connection to a negative pressure source 54. This arrangement enables application of a negative pressure to the interior of pressure control tank 42, so that in combination with maintaining a target level (and volume) of ink within pressure control tank 42 via pump 46 and ink reservoir 44, the vacuum conduit 52 achieves and maintains a target meniscus pressure for printhead assembly 22A.

Printhead assembly 22A is positioned adjacent the surface of the rotary drum 12 via a mounting assembly (not shown) while a media transport assembly, such as rotary drum 12 conveys print medium 27 on a path relative to inkjet printhead assembly 22A. In the example shown, the print medium 27 is introduced onto and held onto rotary drum 12 so that as rotary drum 12 rotates about its axis 14, the print medium 27 is carried along a path underneath the array 21 of printheads 22A, 22B, and 22C. It will be understood that the number of inkjet printhead assemblies in array 21 can vary depending upon the number of colors or style of printing desired. Accordingly, the example printing system 10 is not strictly limited to the quantity of printhead assemblies 22A, 22B, and 22C shown in FIG. 1A.

In another example printing system, the rotary drum 12 does not releasably carry a print medium 27, but instead rotary drum 12 acts an intermediate imaging substrate that receives ink directly onto a surface 13 of rotary drum 12 in the form of a target image, which is then transferred onto a print medium at a later stage of the printing process in a manner analogous to electrophotographic printing. In this arrangement, the surface 13 of rotary drum 12 is equipped with a type of material suited to receive and temporarily hold ink according to an image, which is later transferred or released onto a print medium that comes into contact with the image carried by rotary drum 12.

Accordingly, whether rotary drum 12 releasably carries a print medium 27 or acts as an intermediate imaging substrate, the example printing system 10 includes configurations in which each printhead assembly 22A of an array of printhead assemblies is at a different rotational orientation relative to its associated pressure control tank 42 because each printhead assembly 22A is located at a different position along the arcuate media transport path defined by the arcuate surface of the rotary drum 12.

In one example, the arcuate media transport path includes a generally semi-circular shape, such as would be defined by the cross-sectional shape of a generally cylindrical rotary drum. In one example, a series of printhead assemblies is arranged in a generally arcuate pattern, such as a generally semi-circular pattern that corresponds to the generally semi-circular shape of the example of a media transport path. However, in other examples, the generally arcuate shapes of the media transport path and/or array of printhead assemblies is defined by other curved shapes.

Thus, in order for printhead assembly 22A to be properly aligned to direct its droplet firing path generally perpendicular to the surface of rotary drum 12, the various printhead assemblies 22A, 22B, 22C of array 21 are oriented at different rotational angles relative to a generally vertical orientation (represented by line V). Therefore, to achieve a well-controlled meniscus pressure, a respective pressure control tank 42 associated with each printhead assembly 22A, 22B, 22C is rotated by an angle corresponding to the degree of rotation of its associated printhead assembly 22A, 22B, and 22C. This reciprocal action of printhead assemblies 22A and 22C and their associated pressure control tanks 42 works to place the pressure control tanks 42 in a generally vertical orientation or generally upright posture. In at least this context, a generally vertical orientation or upright posture of a pressure control tank 42 refers to an orientation of pressure control tank 42 in which reference walls 69 of the pressure control tank 42 are aligned to be generally parallel to the generally vertical orientation V. This relationship is later described and illustrated more fully in association with at least FIGS. 6-8. In one aspect, the reference walls 69 refer to those walls of the pressure control tank 42 whose orientation changes relative to the generally vertical orientation V upon rotation of pressure control tank 42 via coupling 60. For example, as shown in FIG. 2A, with pressure control tank 42 in a generally vertical posture, the reference walls 69 are generally parallel to generally vertical orientation V. However, if the pressure control tank 42 is rotated via coupling 60 (such as in direction A) to an orientation other than the one illustrated in FIG. 2A, then reference walls 69 would no longer be generally parallel to the generally vertical orientation V.

It will be understood that in examples in which the pressure control tank 42 has a generally cylindrical shape or other shape, a generally vertical posture of the pressure control tank 42 is determined in a similar manner based on identifying which portion of the walls of the pressure control tank 42 have an orientation that changes relative to the generally vertical orientation V upon rotation of pressure control tank 42 via coupling 60.

In another example, the reciprocal rotation of the printhead assemblies 22A and 22C and their associated pressure control tanks 42 works to maintain a surface 45 of ink 43 in a generally horizontal orientation within pressure control tank 42. However, it will be understood that ink surface 45 can vary somewhat from the horizontal orientation provided that the ink level sensor 50 can operate in an acceptable range and adequate spacing is maintained between the exposed end of vacuum conduit 52 and surface 45 of ink 43 in pressure control tank 42.

Positioning all of the pressure control tanks 42 with a vertically upright posture facilitates achieving and maintaining a consistent meniscus pressure from printhead-to-printhead and from printhead assembly-to-printhead assembly. Moreover, by keeping the exposed end of the vacuum conduit 52 and the ink level sensor 50 in the same relative positions among all of the pressure control tanks 42, a consistent meniscus pressure is achieved across multiple printhead assemblies (e.g. 22A, 22B, 22C) which each have a different rotational orientation relative to a generally vertical orientation V.

Various elements in the Figures are not necessarily to scale for illustrative purposes. In just one example, as shown in FIG. 1A, it will be understood that rotary drum 12 has a diameter that is sufficiently large so that nozzles 25 of a printhead assembly 22A are aligned to have a uniform distance between each nozzle 25 and the print medium 27. Alternatively, in cases where the rotary drum 12 has a smaller diameter and a sharper radius of curvature, the respective nozzles 25 of the printheads 24 have a different height relative to each other to achieve a uniform distance from each nozzle 25 to the arcuate surface of rotary drum 12.

As depicted in FIG. 1A, for illustrative clarity printhead assemblies 22B and 22C are not shown as being connected to a fluid supply assembly 40. However, it will be understood that, like printhead assembly 22A, these printhead assemblies 22B, 22C are equipped with their own fluid supply assembly 40 (including a pressure control tank 42 with ink level sensor 50 and vacuum conduit 52, ink reservoir 44, pump 46, etc.) whose operation is guided by controller 30.

In addition to communicating with pump 46, ink level sensor 50, and negative pressure source 54, the electronic controller 30 also communicates with at least inkjet printhead assembly 22A, 22B, and 22C and media transport assembly, such as rotary drum 12. Electronic controller 30 receives data 33 from a host system, such as a computer, and includes memory for temporarily storing data 33. Typically, data 33 is sent to inkjet printing system 10 along an electronic, infrared, optical or other information transfer path. Data 33 represents, for example, a document and/or file to be printed. As such, data 33 forms a print job for inkjet printing system 10 and includes print job commands and/or command parameters.

In one embodiment, electronic controller 30 provides control of each inkjet printhead assembly 22A, 22B, and 22C including timing control for ejection of ink drops from nozzles 25. As such, electronic controller 30 defines a pattern of ejected ink drops which form characters, symbols, and/or other graphics or images on print medium 27 or an intermediate imaging substrate. Timing control and, therefore, the pattern of ejected ink drops, is determined by the print job commands and/or command parameters. In one embodiment, logic and drive circuitry forming a portion of electronic controller 30 is located on each inkjet printhead assembly 22A, 22B, and 22C. In another embodiment, logic and drive circuitry is located remote from each inkjet printhead assembly 22A, 22B, and 22C.

FIG. 2A is a side view schematically illustrating an example printing subassembly 75. In one example, the printing subassembly 75 includes at least substantially the same features and attributes as the printing system 10 previously illustrated and described in association with FIGS. 1A-1B.

As shown in FIG. 2A, an example printing system subassembly 75 includes printhead assembly 22A and pressure control tank 42, which are mechanically connected together and in fluid communication with each other, via coupling 60. The coupling 60 enables selective rotational positioning of printhead assembly 22A and pressure control tank 42 relative to each other, and therefore acts a rotation joint or pivot mechanism. In the example shown in FIG. 2A, upon placement of a printhead assembly 22A in a non-vertical orientation to align the printhead assembly 22 for firing ink onto rotary drum 12, the pressure control tank 42 is rotated by a corresponding amount to cause the ink surface 45 in the pressure control tank 42 to be in a generally horizontal orientation (H1) while pressure control tank 42 is in a generally vertical posture. It will be understood that in some examples a position of either one of printhead assembly 22A or pressure control tank 42 can be fixed relative a frame of the larger printing system such that just one of the two respective elements remains rotatably movable.

As shown in FIG. 2A, upon selective rotation about coupling 60, inkjet printhead assembly 22A forms an angle ( ) of about 45 degrees relative to a generally vertical orientation (V). However, it will be understood that the angle ( ) is selectable within a range from 0 to 90 degrees, relative to vertical orientation V. FIG. 2A also shows a supplementary angle ($\alpha$) to angle ( ).

In addition, in another example, the rotational orientation of the printhead assembly 22A is measured as an angle ($\beta$) relative to a generally horizontal orientation H2.

In the example printing system 10 shown in FIG. 1A, each respective printhead assembly 22A, 22B, 22C is in a different rotational orientation relative to their associated pressure control tanks 42 (not shown for printhead assemblies 22B, 22C) which are in a generally vertical orientation. Accordingly, because each printhead assembly 22A, 22B, 22C is in a different position along the arcuate media transport path defined by the arcuate surface of the rotary drum 12 as shown in FIG. 1A, the angle ( ) represented in FIG. 2A will be different for each printhead assembly 22A, 22B, 22C relative to the generally vertical orientation V while each pressure tank 42 will be positioned to have ink surface 45 aligned with the generally horizontal orientation (represented by H1). For example, with reference to both FIGS. 1A and 2A, the angle ( ) for printhead assembly 22A is about 45 degrees, while the angle ( ) for printhead assembly 22B is about 0 degrees, and the angle ( ) for printhead assembly 22C is about 25 degrees.

With further reference to the example printing subassembly 75 shown in FIG. 2A, coupling 60 comprises a mechanical structure, such as a rotation joint, enabling movement of the inkjet printhead assembly 22A into one selected rotational position among a plurality of selectable rotational positions relative to pressure control tank 42. In this example, coupling 60 also includes a conduit structure to route ink 43 from pressure control tank 42, via manifold 26, into the printheads 24 of inkjet printhead assembly 22A. In this way, regardless of the selected rotational position of inkjet printhead assembly 22A relative to pressure control tank 42, an adequate supply of ink is maintained to printhead assembly 22A.

Further details regarding one example of such a mechanical and fluidic coupling structure for coupling 60 is later described and illustrated in association with at least FIGS. 3-8.

Figure 2B:
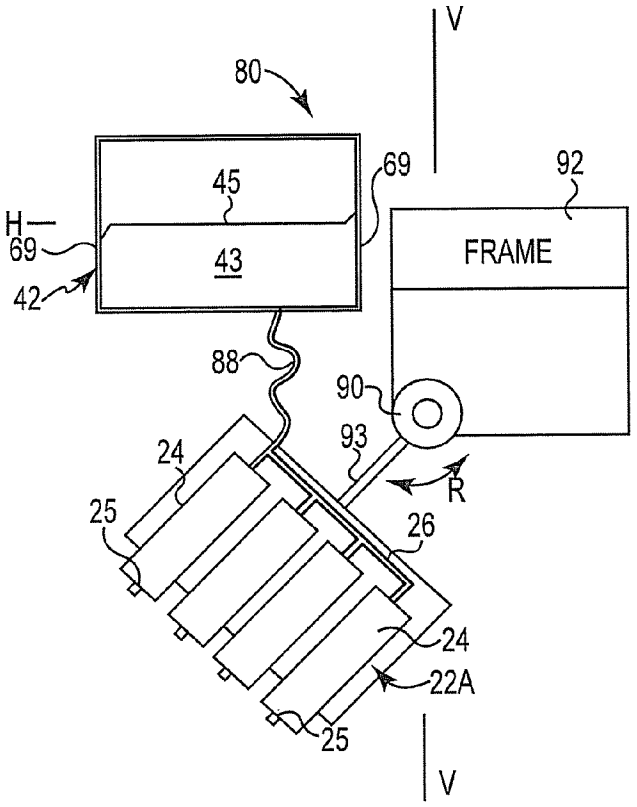
FIG. 2B is a side view schematically illustrating an example of one printing assembly in the present disclosure.
Figure 2A:
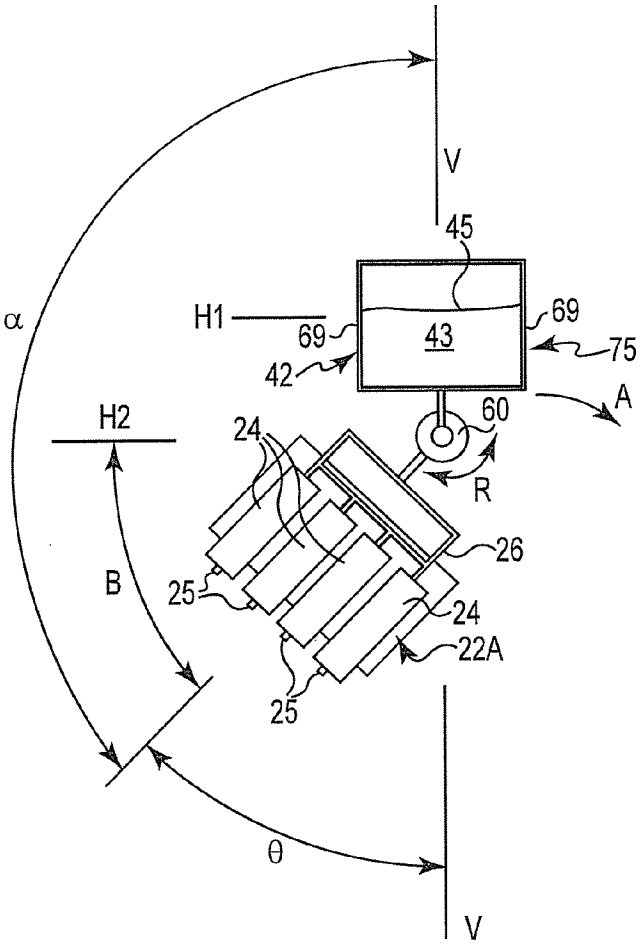
FIG. 2A is a side view schematically illustrating an example of one printing assembly in the present disclosure.

FIG. 2B is a side view schematically illustrating an example printing subassembly 80, which includes at least substantially the same features and attributes of printing system 10 (as previously described and illustrated in association with FIG. 1) except for providing a different coupling mechanism (than shown in FIG. 2A) between pressure control tank 42 and the inkjet printhead assembly 22A. In particular, as shown in FIG. 2B, the example printing subassembly 80 includes a mechanical coupling 90 supported by a frame 92 and includes a fluidic coupling 88. In this example, the mechanical coupling 90 is separate from, and independent of, the fluidic coupling 88. In one aspect, printhead assembly 22A includes a generally rigid support structure 93 that connects to coupling 90 and that cooperates with a pivot mechanism of coupling 90 to enable selective rotation of printhead assembly 22A. On the other hand, fluidic coupling 88 is made of a generally flexible conduit or resilient conduit, to allow routing the conduit about other structures of the printing system.

Frame 92 is a stationary structure that supports mechanical coupling 90, which provides selective rotational positioning of printhead assembly 22A relative to frame 92, and therefore, relative to a generally vertical orientation V. This arrangement, in turn, enables rotation of printhead assembly 22A and pressure control tank 42 relative to one another to cause pressure control tank 42 to be aligned in a generally vertical orientation or upright posture. Moreover, because pressure control tank 42 is separate from, and independent of, the frame 92, the pressure control tank 42 is capable of being positioned within printing system 10 at various desired locations, which may be more convenient or space-efficient than if pressure control tank 42 were still fluidically connected via coupling 60 to printhead assembly 22A.

Moreover, in this arrangement in which the fluidic coupling 88 is separate from mechanical coupling 90, some example printing subassemblies include a single pressure control tank that supplies ink to multiple printhead assemblies 22A.

Accordingly, in the example printing subassembly 80, achieving a selected rotational position of printhead assembly 22A relative to pressure control tank 42 is not dependent on co-locating the fluidic coupling 88 with the mechanical coupling 90 that enables rotational positioning of printhead assembly 22A. Accordingly, printing subassembly 80 enables great flexibility in laying out components of a printing system and enables the coupling 90 between the printhead assembly 22A and the pressure control tank 42A to be simplified because fluid need not be routed through the same structure that is providing the mechanically-controlled rotational positioning.

Figure 3:
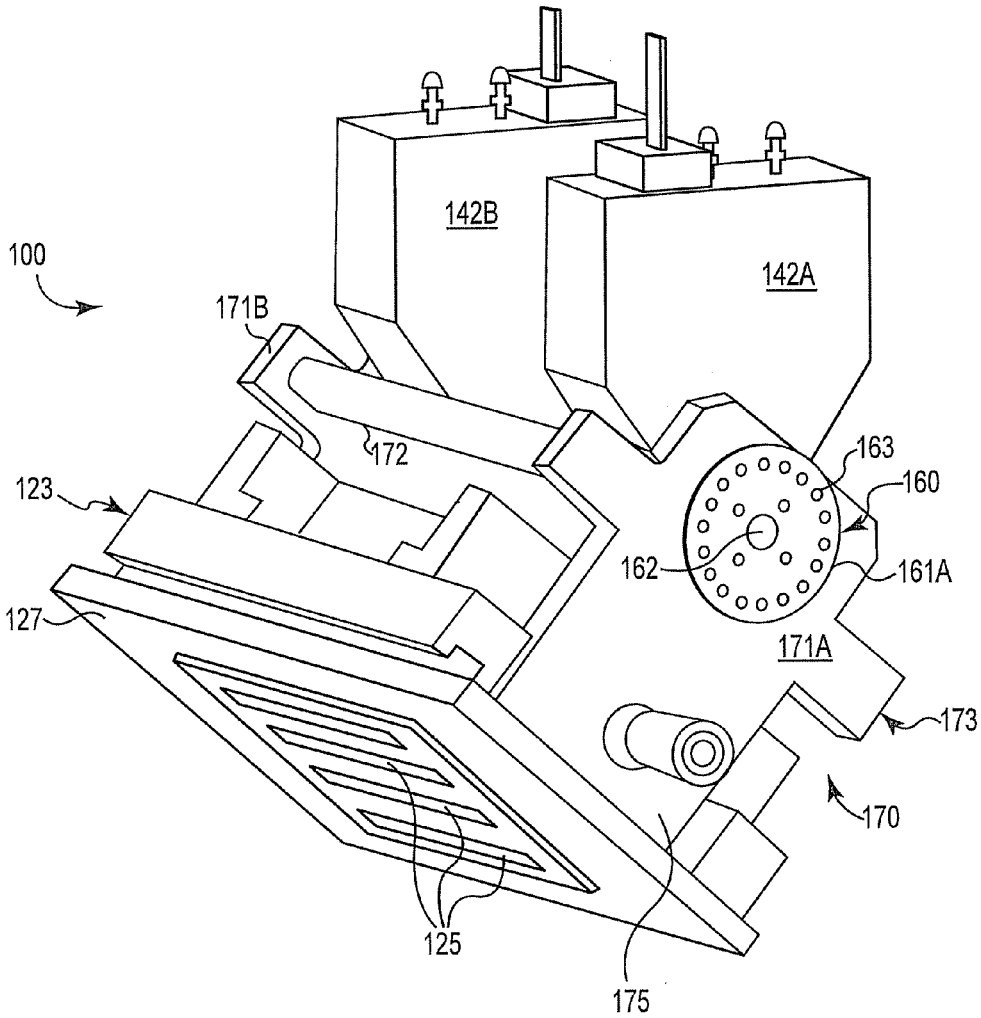
FIG. 3 is an isometric view schematically illustrating an example of one printing assembly in the present disclosure.

FIG. 3 is an isometric view schematically illustrating an example printing subassembly 100 of the present disclosure. In one example, the printing subassembly 100 includes at least substantially the same features and attributes as printing subassembly 75 shown in FIG. 2A. In another example, printing subassembly 100 forms part of a larger printing system having at least substantially the same features and attributes as the example printing system 10, as previously described and illustrated in association with FIGS. 1A and 1B.

As shown in FIG. 3, an example printing subassembly 100 includes a printhead assembly 170, a pair of pressure control tank assemblies 142A, 142B, and a coupling 160 that fluidically and mechanically couples the printhead assembly 170 to the pressure control tank assemblies 142A, 142B. Printhead assembly 170 comprises a frame 173 that includes at least a pair of spaced apart side frame members 171A, 171B. The pressure control tank assemblies 142A, 142B also are spaced apart from each other along an orientation generally parallel to the orientation by which side frame members 171A, 171B are spaced apart from each other. A rod 172 extends between, and connects, the respective side frame members 171A, 171B. A distal end 175 of the side frame members 171A, 171B supports a bottom frame member 127, which also extends between and connects the respective side frame members 171A, 171B. An inkjet printhead structure 123 is supported within the frame 173 and includes an array of nozzles 125 for ejecting ink droplets onto a print medium or intermediate imaging substrate.

Among other elements, coupling 160 includes a generally circular plate 161A that defines an array of holes 163 about a periphery or outer edge of the plate 161A and that defines a central hole 162.

As shown in FIG. 3, printhead assembly 170 is shown in a rotated position relative to pressure control tanks assemblies 142A, 142B in a manner generally the same as printhead assembly 22A is rotated relative to pressure control tank 42, as previously described and illustrated in association with FIGS. 1, 2A, and 2B.

Further details regarding the printing subassembly 100, including pressure control tank assemblies 142A, 142B, are more fully described later in association with at least FIGS. 4-8.

Figure 4:
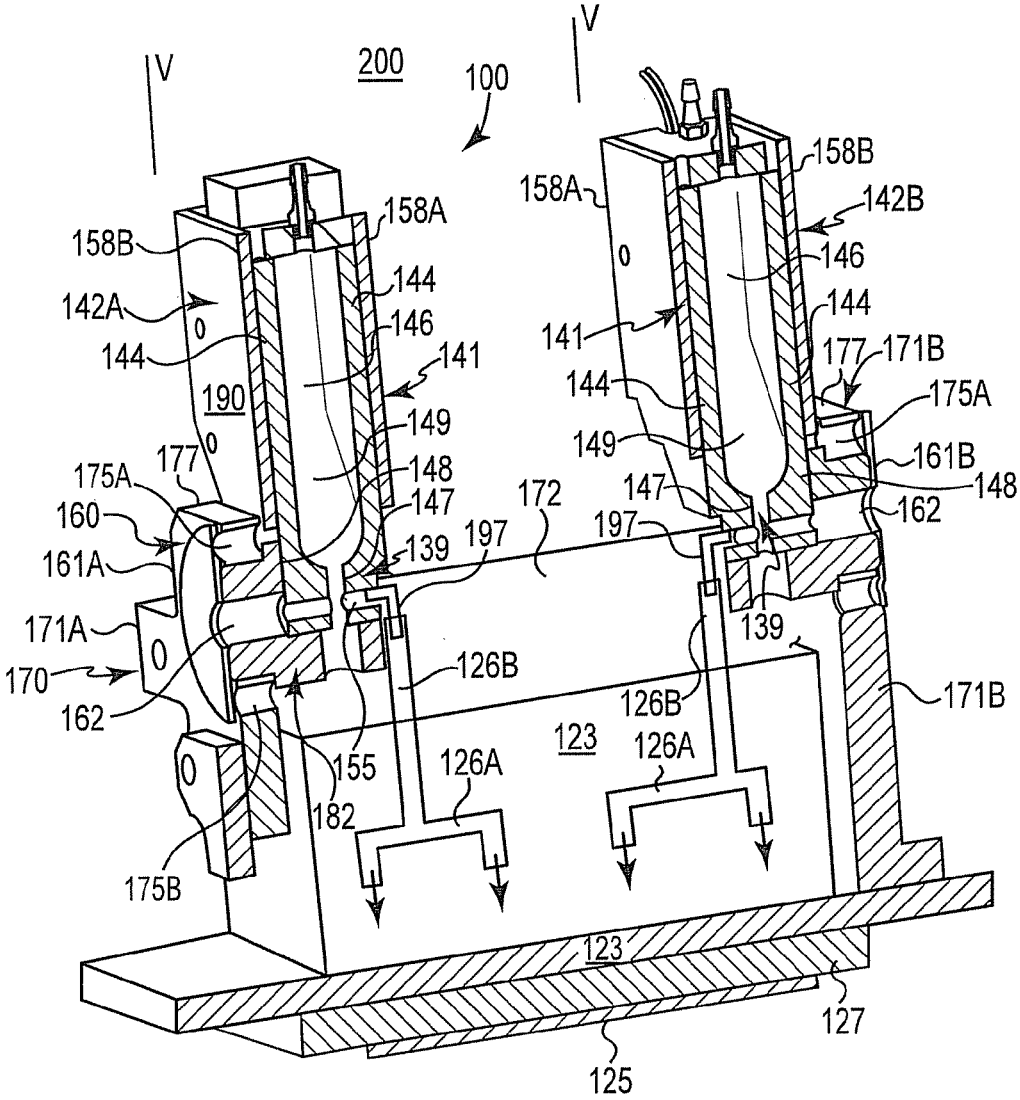
FIG. 4 is a sectional view schematically illustrating an example of one printing assembly in the present disclosure.
Figure 5A:
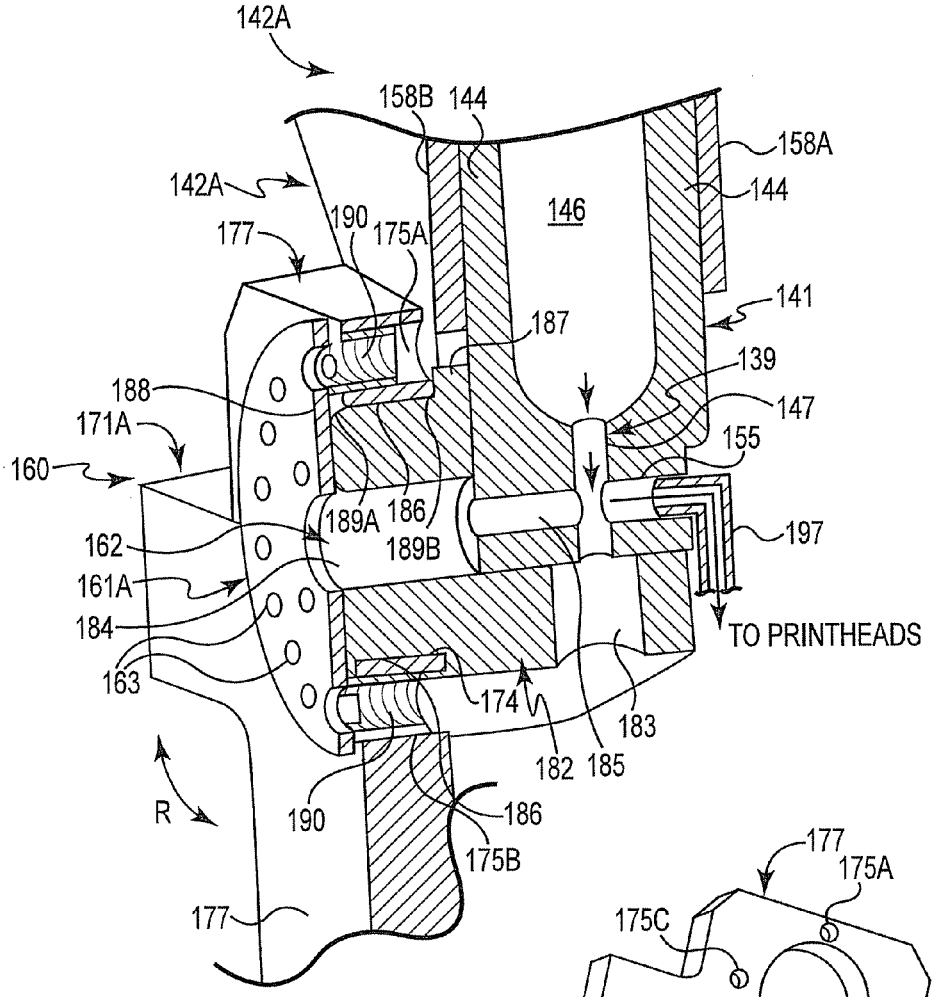
FIG. 5A is an enlarged partial sectional view schematically illustrating the example of a printing assembly of FIG. 4.
Figure 5B:
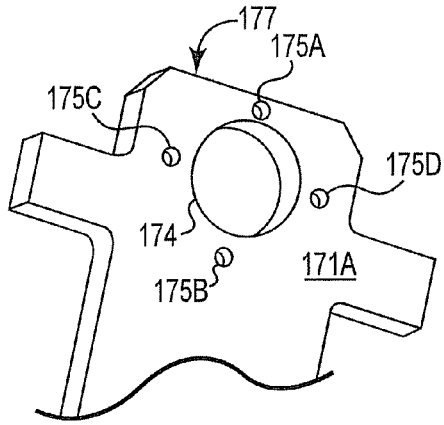
FIG. 5B is a partial isometric view schematically illustrating one example of a side frame member of the example printing assembly of FIG. 4.

FIG. 4 is a sectional view of the example printing subassembly 100 of FIG. 3 (with printhead assembly 170 in a different rotational position than shown in FIG. 3) while FIG. 5A is an enlarged partial sectional view of the example printing subassembly 100 that further highlights the example coupling 160 and pressure tank 141. Meanwhile, FIG. 5B is an isometric view of an upper portion 177 of a side frame member 171A that forms part of coupling 160. While FIG. 5A shows the coupling 160 at just one side of the printing subassembly 100, it will be understood that the other side of the printing subassembly 100 would include a coupling like coupling 160 except having a reverse or mirrored orientation relative to the arrangement shown in FIG. 5A.

Figure 8:
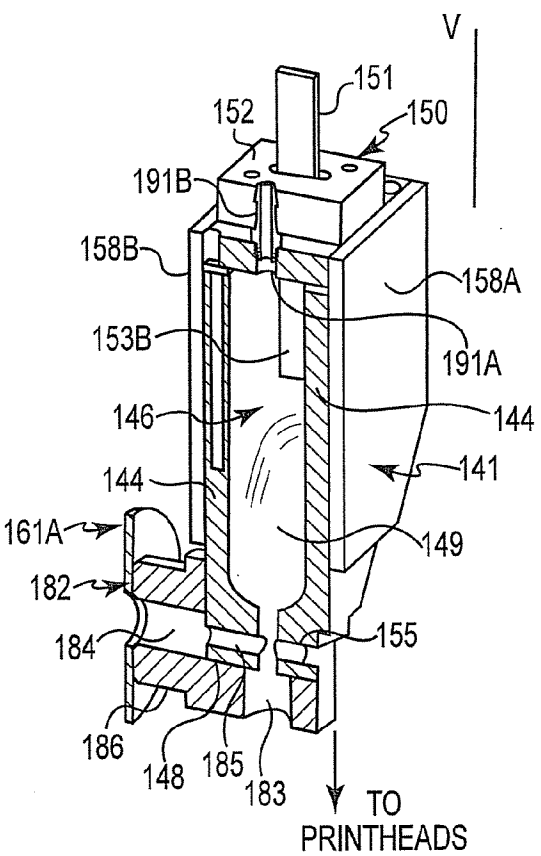
FIG. 8 is a sectional view taken along lines 8-8 of FIG. 6 of the example of a control tank in the present disclosure.
Figure 7:
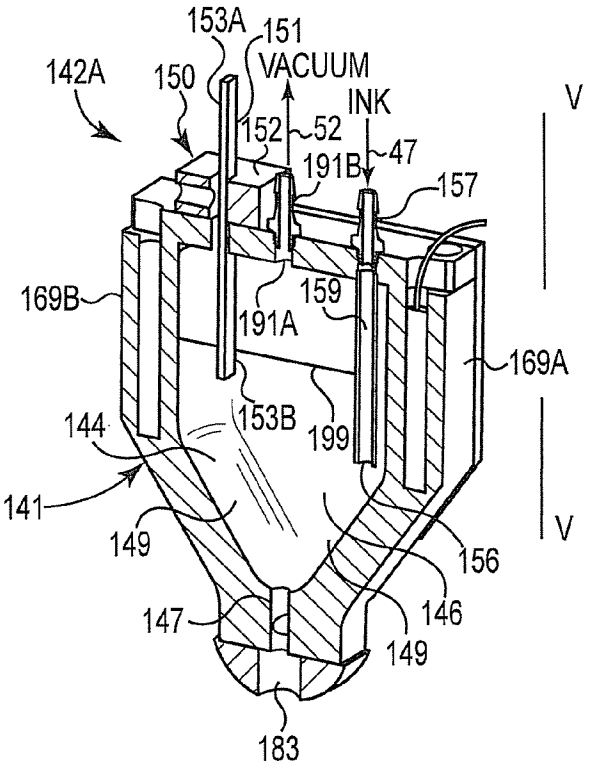
FIG. 7 is a sectional view taken along lines 7-7 of FIG. 6 of the example control tank in the present disclosure.
Figure 6:
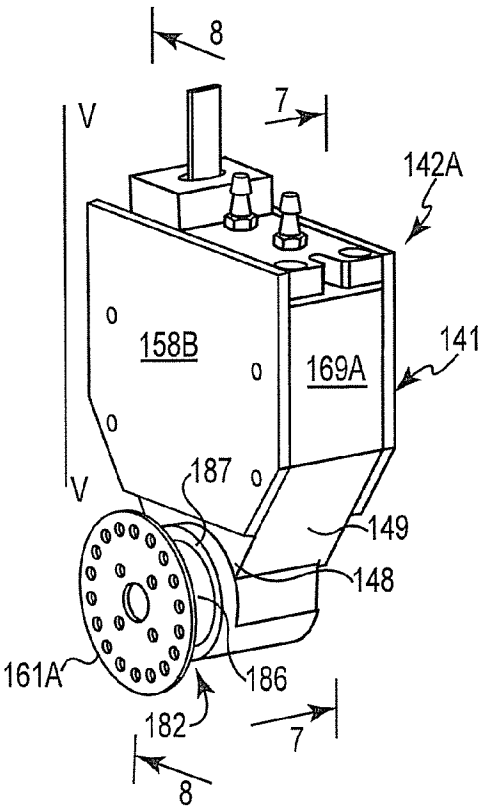
FIG. 6 is an isometric schematically illustrating one example of a control tank in the present disclosure.

FIGS. 6-8 further illustrate the example pressure control tank assembly 142A previously described in association with at least FIGS. 4 and 5A. Accordingly, FIG. 6 is an isometric view of the example pressure control tank assembly 142A that highlights mounting disc 182 and plate 161A. FIG. 7 is a sectional view as taken along lines 7-7 of FIG. 6 depicting example pressure tank 141 while FIG. 8 is a sectional view as taken along lines 8-8 of FIG. 6 further depicting pressure control tank 141.

With this in mind, as shown in at least FIGS. 4 and 5A, each pressure control tank assembly 142A, 142B includes a tank 141 including at least a pair of side walls 144 and end walls 169A, 169B (shown in FIGS. 6-7) that define a chamber 146 for holding ink therein. In one example, end walls 169A, 169B correspond to the previously described reference walls 69 (FIG. 2A) used to determine a posture of pressure control tank 42 relative to a generally vertical orientation. An outer plate 158A, 158B is disposed on the exterior of each side wall 144. Tank 141 also includes a pair of angled portions 149 that converge toward each other (also shown in FIGS. 6-7), thereby forming a funnel shape to facilitate flow of ink out of the chamber 146 while preventing sediment accumulation.

As further shown in at least FIGS. 4-5A and 7-8, a bottom portion of pressure control tank 141 includes a drain portion 139 defined by outlet 147 and conduit 155, which receives fitting 197. Accordingly, ink travels from chamber 146 of each pressure control tank 141 through outlet 147 and conduit 155 before exiting via fitting 197 into a respective conduit structure 126B and a respective manifold 126A associated with printhead structure 123. In another example, the separate manifolds 126A feed a single printhead structure. In some examples, the separate manifolds 126A each feed their own separate printhead structure with one printhead structure being associated with just one of the control tanks 141. In this latter example, the fluidic pathway from one control tank 141 (of the pair of control tanks 141) to a printhead assembly is separate from and independent of the fluidic pathway from the other control tank 141 to its associated printhead assembly.

While these respective fluidic pathways define part of the coupling 160 between a respective pressure control tank assembly 142A, 142B and printhead assembly 170, operation of the respective fluidic pathways is unaffected by rotation of printhead assembly 170 and pressure control tank assemblies 142A, 142B relative to one another. In one aspect, a longitudinal axis of the conduit 155 is common with the axis extending through hole 162 (and through hole 184 of mounting disc 182), about which the printhead assembly 170 and pressure control tank assembly 142A rotate relative to one another.

It will be understood that other structures shown in at least FIGS. 4 and 5A, such as bore 183 and 185 are used for mounting, sealing, and/or other functions.

In another example, manifolds 126A are joined together to provide a single manifold common to the printhead structure 123.

As shown in at least FIGS. 4 and 5A-5B, side frame member 171A of printhead assembly 170 includes an upper portion 177 defining a central hole 174. In addition, side frame member 171A defines several smaller holes 175A, 175B, 175C, 175D arranged circumferentially in a generally circular pattern around a periphery of central hole 174 with holes 175A, 175B. In one example the holes 175A, 175B, 175B, 175D are spaced apart from each other by about 90 degrees. However, it will be understood that there can be fewer or greater than four holes and that depending upon the number of holes, the rotational angle between them will be less or greater, respectively.

Meanwhile, with further reference to at least FIGS. 4 and 5A, pressure control tank assembly 142A, 142B includes a mounting disc 182 located at a lower, exterior portion 148 of pressure control tank 141 with mounting disc 182 sized and shaped to extend within and through central hole 174 of first portion 173 of side frame member 171A. The plate 161A is secured to an outer surface 188 of mounting disc 182 with hole 162 of plate 161A aligned with bore 184 of mounting disc 182, thereby causing upper portion 177 of side frame member 171A to be interposed between plate 161A and the lower, exterior portion 148 of pressure control tank 141. Moreover, mounting disc 182 defines a generally cylindrically shaped bearing surface 186 about which the central hole 174 of side frame member 171A is slidably rotatable, thereby defining at least a portion of a pivot mechanism of coupling 160. In one aspect, a first end 189A of bearing surface 186 is laterally bounded by plate 161A and a second end 189B of bearing surface 186 is bounded by a side wall 187 defined by mounting disc 182, thereby constraining lateral movement of side frame member 171A relative to bearing surface 186. In another aspect, plate 161A is positioned laterally outward from bearing surface 186.

As further shown in FIG. 5A, each hole 175A, 175B, 175C, 175D of side frame member 171A is sized and shaped to receive a spring plunger 190. A working tip of the respective spring plungers 190 is oriented to face the plate 161A, and as shown in FIG. 5A, to slidably engage one of the holes 163 defined about the outer circular edge of plate 161A. In this way, each spring plunger 190 acts as a releasable securing mechanism to releasably secure the side frame member 171A in a selected rotational position relative to mounting disc 182 of pressure control tank assembly 142A. Based on the ninety degree angular spacing between holes 175A, 175B, 175C, 175D, the spring plungers 190 are likewise circumferentially spaced apart from each other by about ninety degrees. In one example, the spring plungers 190 comprise a ball-type spring plunger while in other examples, the spring plungers 190 comprise a pin-type spring plunger.

Accordingly, when an operator moves printhead assembly 10 relative to pressure control tank assembly 142A, 142B (or vice versa), the force exerted by spring plungers 190 in holes 163 of plate 161A, 161B is overcome and the spring plungers 190 permit slidable rotation (represented by directional arrow R) of upper portion 177 of side frame member 171A about bearing surface 186 of mounting disc 182 of pressure control tank assembly 142A and relative to plate 161A. This slidable rotation is continued until the operator terminates forced movement of the printhead assembly 170 at which time the spring plungers 190 engage the closest available holes 163 on plate 161A to once again releasably secure side frame member 171A (and printhead assembly 170) relative to plate 161A of pressure control assembly 142A. In this way, the example printing subassembly 100 enables selective rotational positioning of printhead assembly 170 and pressure control tank assembly 142A, 142B relative to each other.

It will be further understood that by varying the number of holes 175A, 175B, 175C, 175D (and associated spring plungers 190), one can vary the number of rotatable positions of printhead assembly 170, assuming a fixed circumferential spacing between the holes 163 of plate 161A.

As shown in at least FIG. 7, pressure control tank 141 includes a vacuum port 191A that is defined in a wall of chamber 146 to be exposed at or within an interior of chamber 146 of control tank 141. The vacuum port 191A is provided for drawing and maintaining a vacuum pressure on ink within chamber 146 for meniscus control, among other functions. In one example, the vacuum port 191A is located at a top wall of chamber 146 to maximize the spacing of vacuum port 191A away from a target fluid level within chamber 146 of tank 141. This arrangement reduces the chance of ink entering the vacuum port 191A. Via a fitting 157, vacuum port 191A is in fluid communication with a vacuum conduit 52, which is in turn, in communication with a negative pressure source 54 (FIG. 1) external to control tank 141. While not shown in FIG. 7, it will be understood that in other examples vacuum port 191A can be located on one of the side walls of control tank 141 that define chamber 146, provided that port 191A is located above the target fluid level 199 in chamber 146.

As further shown in FIG. 7, pressure control tank 141 includes an ink level sensor 150 including an ink level element 151 having a first end 153A and an opposite, second end 153B. The second end 153B protrudes down into the chamber 146 at a depth sufficient to be immersed into the ink in chamber 146 below target fluid level 199 while first end 153A protrudes externally of and outwardly from a top portion of the pressure control tank 141. Sensor circuitry portion 152 determines the level of ink based on a position of element 151, which is in turn communicated to controller 30 (FIG. 1).

As further shown in at least FIGS. 7-8, pressure control tank 141 includes an ink fill conduit 159 in fluid communication with a fitting 157, through which ink is supplied via ink conduit 47 from ink reservoir 44 upon selective action of pump 46 (FIG. 1A). In one aspect, conduit 159 has a length sized to cause a mouth 156 at a distal end of the conduit 159 to extend at least below the target fluid level 199 within the chamber 146. Via the rotationally adjustability of control tank 141 to maintain a generally vertical posture as described above, the example pressure control tank assembly 142A, 142B ensures that the mouth 156 remains submerged well below a surface of ink in control tank 141, which helps to prevent foaming and/or entraining air into the ink within chamber 146 of control tank 141 as might otherwise occur if the mouth 156 were no longer submerged within the ink upon a tilting of the control tank as could occur in existing systems.

Accordingly, the coupling 160 shown in FIGS. 4-8 enables selective rotation of pressure control tank assembly 142A, 142B relative to a respective side frame member 171A, 171B and enables fluid communication between pressure control tank 141 and printhead structure 123 of printhead assembly 170.

Figure 9:
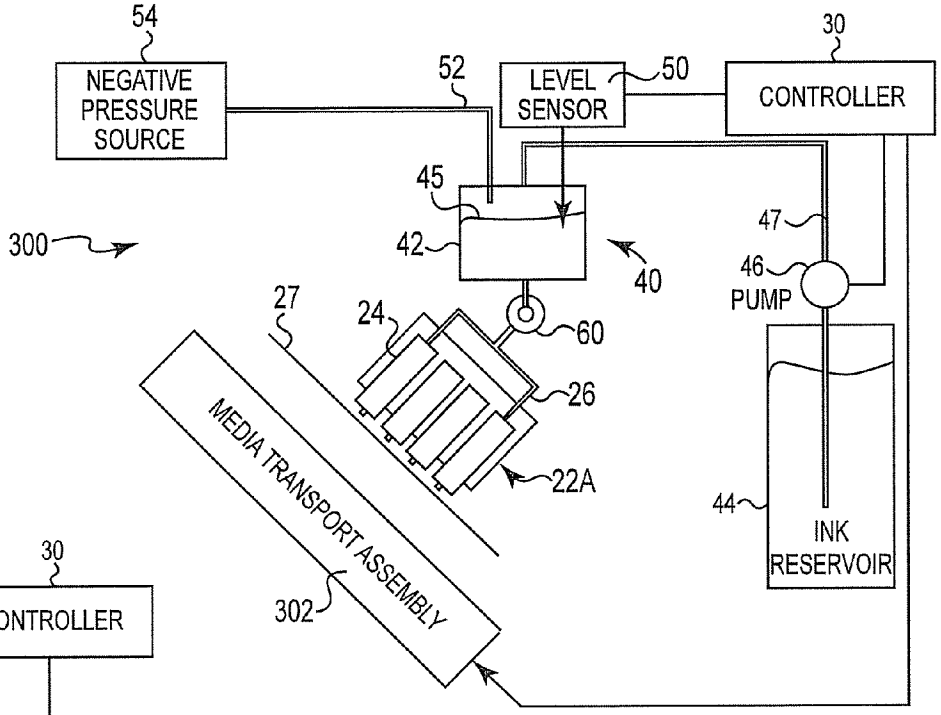
FIG. 9 is a block diagram schematically illustrating one example of a printing system in the present disclosure.

FIG. 9 is a block diagram schematically illustrating an example printing system 300, according to the present disclosure. The example printing system 300 includes at least substantially the same features and attributes as printing system 10, as previously described in association with FIGS. 1-8, except for replacing rotary drum 12 (FIG. 1) with a different type of media transport assembly 302. For example, the adjustable rotational position of printhead assembly 22A enables printing system 300 to employ alternate media transport paths in which print medium 27 is oriented at non-horizontal positions during printing. Such configurations are deployable to achieve compact layout of components within a printer and/or to achieve different geometric-spatial layout of the components of a printing system. In one example, the media transport assembly 302 includes an imaging substrate defining a generally planar element on which print medium 27 is transported to align print medium 27 in a generally non-horizontal orientation. In one example, non-horizontal orientation defined by the generally planar element extends at angle between about 10 to about 80 degrees relative to a generally horizontal orientation. In other examples, the non-horizontal orientation extends at an angle between about 30 and about 60 degrees relative to a generally horizontal orientation (such as H2 in FIG. 2A).

Figure 10:
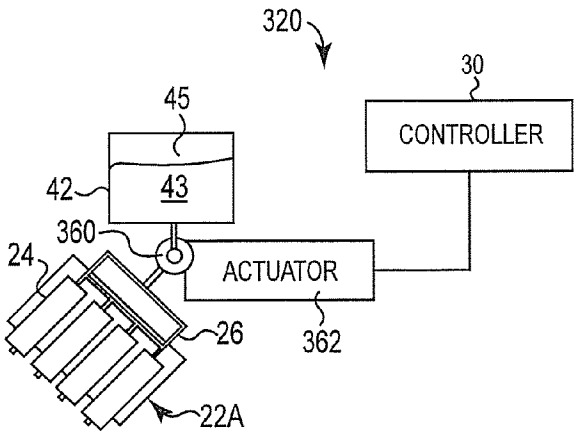
FIG. 10 is a block diagram schematically illustrating one example of a printing assembly in the present disclosure.

FIG. 10 is a block diagram schematically illustrating an example printing system 320. The example printing system 320 includes at least substantially the same features and attributes as printing system 10, as previously described in association with FIGS. 1-8, except for replacing coupling 60 with a combination of coupling 360 and actuator 362. In the example printing subassembly 100 shown in at least FIGS. 4 and 5A, the coupling 60 included a manually controlled mechanical mechanism for achieving a selected rotational position of a printhead assembly 170 relative to pressure control tank assembly 142A, 142B. However, in the example printing system 320 of FIG. 10, via electronically controlled actuator 362, coupling 360 provides an automated, electromechanical selection and achievement of the rotational position of printhead assembly 22A relative to pressure control tank 42. Actuator 362 receives signals from controller 30 regarding a target rotational position while actuator 362 communicates rotational position information of the printhead assembly 22A and control tank 42 to controller 30. While actuator 362 can take many forms, in one example, the actuator 362 includes a motor in electrical communication with controller 30 and gearing associated with the motor for causing selective rotation of printhead assembly 22A.

In this example printing system 320, the electromechanical coupling 360 with actuator 362 enables quicker adjustment of the rotational position of printhead assembly 22A in the event that printing system 320 is used with a media transport assembly or particular print mediums that dictate altering the rotational position of the printhead assembly 22A. In one aspect, the electromechanical coupling 360 with actuator 362 provides the ability to make small or fine adjustments to the rotational position of the printhead assembly, which facilitates printhead alignment relative to the print medium and media transport assembly, such as rotary drum 12 (FIG. 1).

Example printing systems of the present disclosure facilitate maintaining well-controlled meniscus pressure for a printhead assembly by providing selective rotational positioning of the printhead assembly and a pressure control tank relative to one another. The arrangement facilitates proper functioning of an ink level sensor and vacuum line disposed within the pressure control tank. In one aspect, the selective rotational positioning of the pressure control tank and the printhead assembly relative to one another enables establishing and maintaining a generally vertical posture of the pressure control tank, which in turns, enables the vacuum pressure system and ink level system to function properly. With this capability, an array of printhead assemblies can be arranged in an arc-like pattern about a periphery of an arcuate imaging substrate (such as a rotary drum) without sacrificing any performance of the various inkjet printhead assemblies.

Although specific embodiments have been illustrated and described herein, a variety of alternate and/or equivalent implementations may be substituted for the specific examples shown and described without departing from the scope of the present disclosure. This application is intended to cover any adaptations or variations of the specific embodiments discussed herein. Therefore, it is intended that this present disclosure be limited only by the claims and the equivalents thereof.

What is claimed is:

1. A printing assembly comprising:

at least one control tank to hold a volume of fluid and rotationally positionable into a vertical orientation; and a plurality of printhead assemblies with each printhead assembly being separate from, and independent of, the at least one control tank, with each printhead assembly in fluid communication with the at least one control tank, wherein each printhead assembly is selectively rotatable into a plurality of different rotated positions relative to the vertical orientation to cause a droplet firing path of each respective printhead assembly in each of the different rotated positions to be aligned perpendicular to an imaging substrate on a rotary drum, wherein the plurality of printhead assemblies are arranged in series extending about at least a portion of a periphery of the rotary drum such that at least some of the respective printhead assemblies are aligned in a respective one of the rotated positions, relative to the vertical orientation of the at least one control tank, that is different than the rotated position of other respective printhead assemblies.

2. The printing assembly of claim 1, wherein the at least one control tank defines a chamber to hold the volume of fluid, the chamber including at least one wall having a vacuum port connectable to a negative pressure source external to the at least one control tank, wherein the vacuum port is vertically positioned above, and spaced apart from, a target fluid level within the chamber of the at least one control tank, and wherein the printing assembly includes an ink level sensor coupled to the at least one control tank to detect a level of fluid within the chamber of the at least one control tank.

3. The printing assembly of claim 1, comprising:

a first coupling interposed between the at least one control tank and the respective printhead assemblies, the first coupling including a pivot mechanism by which the respective printhead assemblies are selectively rotatable into the plurality of different positions relative to the vertical orientation, and wherein the first coupling includes a first conduit to provide the fluid communication between the at least one control tank and the respective printhead assemblies.

4. The printing assembly of claim 3, wherein the pivot mechanism of the first coupling includes a lower exterior portion of the at least one control tank defining a bearing surface and an upper portion of a respective one of the printhead assemblies slidably, rotatably mounted onto the bearing surface, and wherein the first coupling further comprises:

the lower exterior portion of the at least one control tank including a plate mounted adjacent the bearing surface with the plate defining a plurality of holes arranged about an outer circular edge of the plate; and the upper portion of the respective one printhead assembly including a securing mechanism positioned to releasably engage at least one hole of the plate to releasably secure the upper portion of the respective printhead assembly relative to the plate and into one of a plurality of different rotatable positions relative to the at least one control tank.

5. The printing system of claim 4, wherein the lower portion of the at least one control tank defines a pair of angled wall portions that converge toward each other to define a drain outlet that forms at least a portion of the first conduit of the coupling, wherein a longitudinal axis of at least a portion of the drain outlet is common with a rotational axis of the pivot mechanism.

* * * * *